US007212766B2

(12) United States Patent
Kang

(10) Patent No.: US 7,212,766 B2
(45) Date of Patent: May 1, 2007

(54) WET-TYPE ELECTROPHOTOGRAPHIC IMAGE FORMING APPARATUS AND A SETTING METHOD THEREOF

(75) Inventor: Dong-ju Kang, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 65 days.

(21) Appl. No.: 10/937,409

(22) Filed: Sep. 10, 2004

(65) Prior Publication Data

US 2005/0238383 A1 Oct. 27, 2005

(30) Foreign Application Priority Data

Apr. 26, 2004 (KR) ..... 10-2004-0028611

(51) Int. Cl.
*G03G 15/00* (2006.01)

(52) U.S. Cl. ..... 399/110; 399/107; 399/120; 399/238

(58) Field of Classification Search ..... 399/110, 399/237, 238, 358–360, 257, 120, 107, 126, 399/119, 411, 1; 347/108; 464/176–178; 312/327–328

See application file for complete search history.

(56) References Cited

U.S. PATENT DOCUMENTS

| | | | | |
|---|---|---|---|---|
| 5,631,681 | A * | 5/1997 | Klaus et al. | 347/85 |
| 2004/0161272 | A1* | 8/2004 | Park et al. | 399/358 |
| 2005/0036810 | A1* | 2/2005 | Murakami et al. | 399/360 |
| 2005/0238383 | A1* | 10/2005 | Kang | 399/110 |

FOREIGN PATENT DOCUMENTS

| | | | |
|---|---|---|---|
| JP | 57-121944 | | 7/1982 |
| JP | 03-091784 | | 4/1991 |
| JP | 03-266876 | | 11/1991 |
| JP | 05019546 | A * | 1/1993 |
| JP | 07-276726 | | 10/1995 |
| JP | 08-286509 | | 11/1996 |
| JP | 10-339993 | | 12/1998 |
| JP | 11-065296 | | 3/1999 |
| JP | 2000-284660 | | 10/2000 |
| JP | 2001-117433 | | 4/2001 |
| JP | 2001-154438 | | 6/2001 |
| JP | 2002-268357 | | 9/2002 |
| JP | 2003-271038 | | 9/2003 |
| KR | 1998-0001288 | | 3/1998 |
| KR | 2003-0070456 | | 8/2003 |

* cited by examiner

*Primary Examiner*—David M. Gray
*Assistant Examiner*—Ryan D. Walsh
(74) *Attorney, Agent, or Firm*—Roylance, Abrams, Berdo & Goodman, LLP

(57) ABSTRACT

A wet-type electrophotographic image forming apparatus and a setting method thereof, comprising a body, a developing unit, an ink cartridge unit for supplying an ink to the developing unit, a door unit, an ink recovery unit for discarding waste ink and circulating ink, and a fitting unit connecting the developing unit and the ink cartridge unit. The door unit moves in relation to the movement of at least one of the ink recovery unit and the fitting unit, allowing a user to easily and precisely set the fitting unit and the ink recover unit using the door unit, which can further support and guide the developing unit 20.

36 Claims, 8 Drawing Sheets

WET-TYPE ELECTROPHOTOGRAPHIC IMAGE FORMING APPARATUS AND A SETTING METHOD THEREOF

CROSS-REFERENCE TO RELATED APPLICATIONS

This application claims the benefit under 35 U.S.C. §119 (a) of Korean Patent Application No. 2004-28611 entitled "A Wet-Type Electrophotographic Image Forming Apparatus And A Setting Method Thereof", filed in the Korean Intellectual Property Office on Apr. 26, 2004, the entire contents of which are incorporated herein by reference.

BACKGROUND OF THE INVENTION

1. Field of the Invention

The present invention relates to a wet-type electrophotographic image forming apparatus. More particularly, the present invention relates to a wet-type electrophotographic image forming apparatus having a fitting unit and an ink recover unit for discarding waste ink or recycling ink, and a setting method thereof.

2. Description of the Related Art

A wet-type electrophotographic image forming apparatus is a printing device that forms an electrostatic latent image by scanning a photoconductive medium with laser beams, fuses a developer onto the electrostatic latent image to obtain a visible image, transfers the visible image to paper, and outputs a desired image. Compared to a dry-type electrophotographic image forming apparatus, the wet-type apparatus is advantageous in that it can obtain a much more vivid image. Therefore, it is more suitable for providing a color printing of high quality.

Furthermore, in the wet type electrophotographic image forming apparatus, ink is circulated from a developing unit to an ink cartridge unit for the purpose of reuse. The recycling procedure is performed by passing ink through a developing unit, an ink recover unit, a fitting unit, and into an ink cartridge unit.

FIG. 1 is a schematic view showing a conventional wet-type electrophotographic image forming apparatus. Referring to FIG. 1, a wet-type electrophotographic image forming apparatus 100 comprises a body 101, a developing unit 102 disposed in the body 101, an ink cartridge unit 106 disposed in the body 101 for supplying ink to the developing unit 102, a door unit 103 disposed in the body 101, and a fitting unit 104 disposed in the body 101. The door unit 103 is provided with a mounting supporter 103*a* for pushing the developing unit 102 in one direction to completely mount the developing unit 102.

The developing unit 102 includes an ink discharge channel cover 102*a* for discharging the ink, and the fitting unit 104 includes a male fitting portion 104*a* fitted into a female fitting portion 106*a* formed in the ink cartridge unit 106.

According to the above construction example, in order to completely mount the developing unit 102, a user has to perform a series of tasks to open the ink discharge channel cover 102*a*, fit the male fitting portion 104*a* into the female fitting portion 106*a*, and then close the door unit 103 in the 'S' direction. These individual tasks can become tedious and can result in the deterioration of the developing unit 102 and the fitting unit 104 over time.

Accordingly, a need exists for a image forming apparatus having a system and method to engage an ink discharge channel and function using a minimum number of individual steps, and preferably, using a motion generated by a single step, such as opening and closing a door unit.

SUMMARY OF THE INVENTION

The present invention has been developed in order to solve the above and other problems in the related art. Accordingly, an object of the present invention is to provide a wet-type electrophotographic image forming apparatus having an improved construction which is capable of facilitating a setting procedure, and a setting method thereof.

The above object is achieved by providing a wet-type electrophotographic image forming apparatus comprising a body, a developing unit disposed in the body, an ink cartridge unit disposed in the body for supplying ink to the developing unit, a door unit disposed in the body, an ink recovery unit disposed in the body for discarding waste ink and circulating ink, and a fitting unit connecting the developing unit and the ink cartridge unit. The door unit moves in relation to the movement of at least one of the ink recovery unit and the fitting unit.

The image forming apparatus further provides the fitting unit to be engaged and disengaged with the ink cartridge unit according to the closing and opening movements of the door unit.

A rotary shaft is disposed in the developing unit of the image forming apparatus, and the door unit includes a mounting support for completely mounting the developing unit, and includes a recess for supporting and guiding the rotary shaft of the developing unit.

The ink cartridge unit of the image forming apparatus includes a female fitting portion formed therein, and the fitting unit includes a male fitting portion and a fitting unit driver. The fitting unit driver is operated according to the closing and opening movements of the door unit to engage and disengage the male fitting portion with the female fitting portion.

The fitting unit driver of the image forming apparatus comprises a rotary member disposed at the door unit, and a vertical member connected to the male fitting portion. The rotary member and the vertical member contact each other, and the vertical member transforms a rotational motion of the rotary member into a linear motion.

The ink recover unit is operated according to the closing and opening movements of the door unit. The developing unit includes an ink discharge channel cover for discharging or circulating ink, and the ink recover unit includes an ink recover unit driver for opening and closing the ink discharge channel cover according to the closing and opening movements of the door unit. The ink recover unit further includes an ink receptacle for collecting the discharged ink.

An operating lever is disposed at the door unit to operate the ink recover unit driver, wherein the ink recover unit driver comprises an opening and closing member to open and close the ink discharge channel cover, an opening and closing shaft engaged with the opening and closing member, and a clutch mounted on the opening and closing shaft. The clutch is operated via a contact with the operating lever.

The above objects are further achieved in another embodiment of the present invention by providing a wet-type electrophotographic image forming apparatus comprising a body, a developing unit disposed in the body, an ink cartridge unit disposed in the body for supplying ink to the developing unit, a door unit disposed in the body, an ink recover unit disposed in the body for discharging waste ink and circulating ink, and a fitting unit connecting the developing unit and the ink cartridge unit. The door unit moves in relation to the movement of at least one of the fitting unit and the ink recover unit.

The above objects are further achieved in yet another embodiment of the present invention by providing a wet-type electrophotographic image forming apparatus comprising a body, a developing unit disposed in the body, an ink cartridge unit disposed in the body for supplying an ink to the developing unit, a door unit disposed in the body, and an ink recover unit disposed in the body for discharging waste ink and circulating ink. The door unit moves in relation to the movement of the ink recovery unit.

The above objects are achieved by providing a setting method of a wet-type electrophotographic image forming apparatus in accordance with an embodiment of the present invention, the method comprising the steps of opening and closing a door unit and moving a fitting unit in relation to the movement of the door unit, the fitting unit being engaged and disengaged with an ink cartridge unit through such movement.

The step of moving the fitting unit further comprises the steps of rotating a rotary member disposed at the door unit, linearly moving a vertical member in engagement with the rotary member, and linearly moving a male fitting portion disposed at the vertical member.

The setting method further comprises the step of detecting the opening and closing of the door unit using a sensor disposed at one side of the door unit. If necessary, the setting method further comprises the steps of determining whether the door unit is opened or closed, and displaying an error message when the door unit is opened.

The setting method further comprises the steps of moving the ink recover unit in relation to the movement of the door unit, and discharging the ink from the developing unit.

The step of moving the ink recover unit comprises the steps of rotating an operating lever disposed at the door unit, rotating a clutch in contact with the operating lever, rotating an opening and closing shaft on which the clutch is disposed, rotating an opening and closing member disposed around the opening and closing shaft, and opening and closing an ink discharge channel cover disposed at the developing unit.

BRIEF DESCRIPTION OF THE DRAWINGS

The above objects and other advantages of the present invention will be more apparent by describing embodiments of the present invention with reference to the drawing figures, in which.

In the figures, it will be understood that like reference numerals refer to like features and structures.

DETAILED DESCRIPTION OF THE EXEMPLARY EMBODIMENTS

Hereinafter, embodiments of the present invention will be described in greater detail with reference to the accompanying figures.

In embodiments of the present invention described below, a wet-type electrophotographic image forming apparatus is exemplified, in which, an ink cartridge unit and a fitting unit move in relation to the movement of a door unit.

Figure 1:
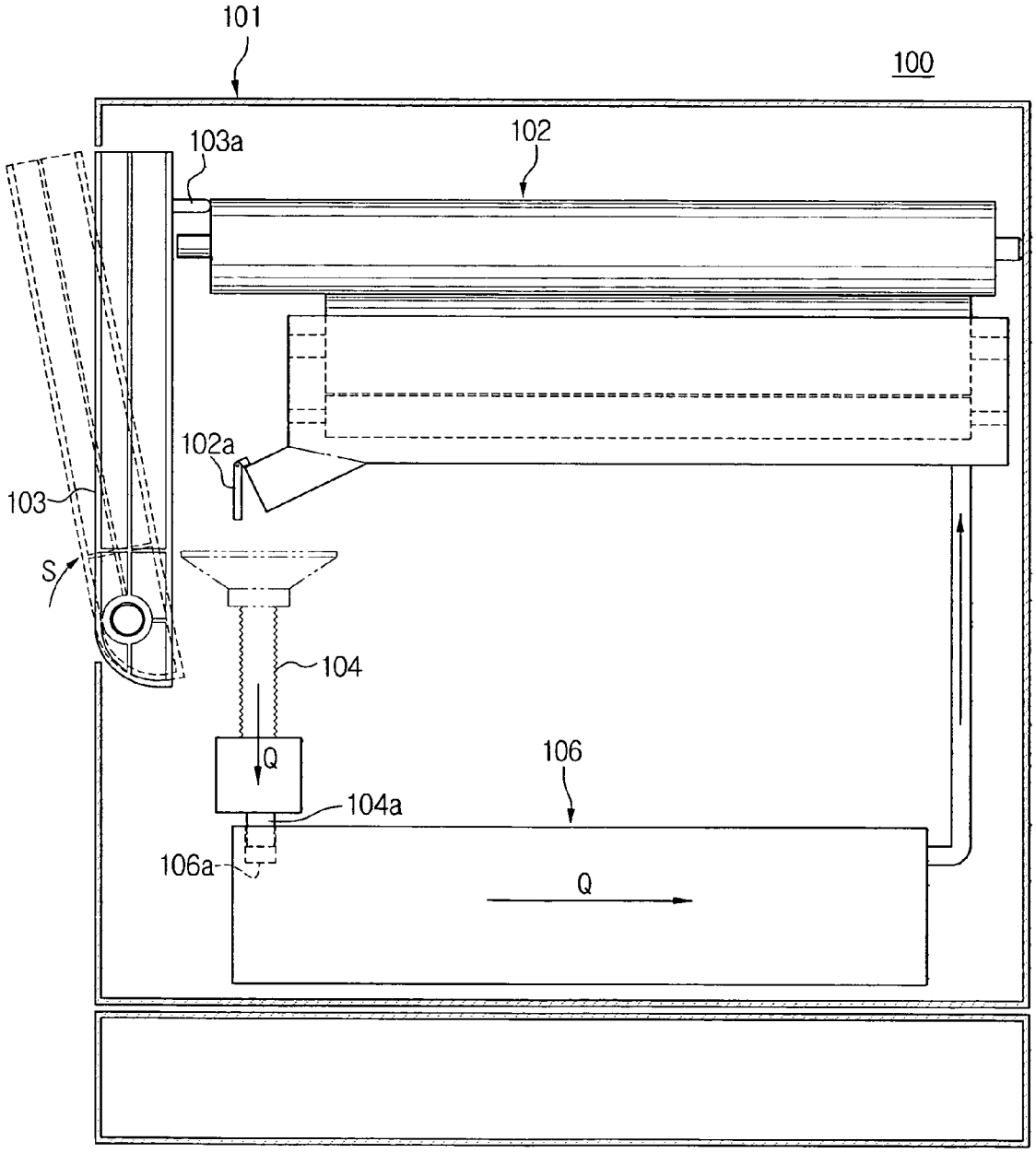
FIG. 1 (PRIOR ART)
FIG. 1 is a schematic view showing a conventional wet-type electrophotographic image forming apparatus.
Figure 2:
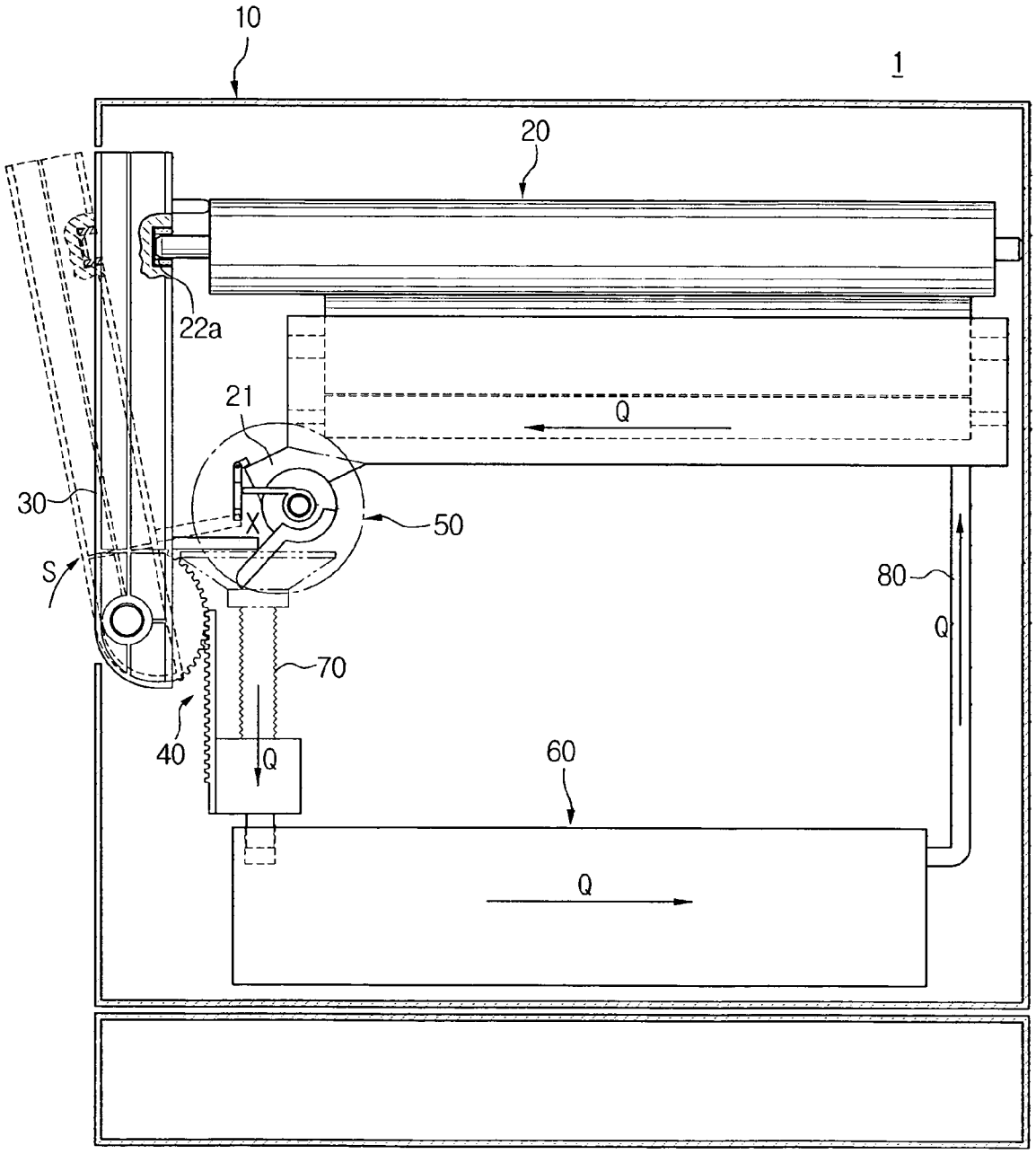
FIG. 2 is a schematic view showing a wet-type electrophotographic image forming apparatus according to an embodiment of the present invention.

FIG. 2 is a schematic view showing a wet-type electrophotographic image forming apparatus according to an embodiment of the present invention. Referring to FIG. 2, a wet-type electrophotographic image forming apparatus 1 comprises a body 10, a developing unit 20, an ink cartridge unit 60, an ink recover unit 50, a fitting unit 40, and a door unit 30.

The developing unit 20 is disposed in an upper part of the body 10 for supplying a developing solution to a photoconductive drum (not shown).

The ink cartridge unit 60 is disposed in a lower part of the body 10 for supplying ink X to the developing unit 20.

The ink recover unit 50 is disposed between an ink discharge channel 21 of the developing unit 20 and the fitting unit 40, and can be securely fixed to the body 10 for collecting the ink X from the developing unit 20.

The fitting unit 40 connects the ink recover unit 50 and the ink cartridge unit 60.

The door unit 30 is hinged on one side of the body 10 for completely mounting the developing unit 20 and also operating the ink recover unit 50 and the fitting unit 40.

Between the ink discharge channel 21 of the developing unit 20 and the ink recover unit 50, the ink X is discharged in a natural manner via gravity without requiring a connecting tube therebetween. A flexible hose 70 is connected between the ink recover unit 50 and the fitting unit 40 to then direct the ink X in an inductive discharging manner.

A connecting hose 80 is also connected between the ink cartridge unit 60 and the developing unit 20 for allowing the ink X to be circulated from the ink cartridge unit 60 to the developing unit 20 in the arrowed direction "Q".

In the above construction example, the ink X is circulated through the developing unit 20, the ink recover unit 50, the fitting unit 40, and the ink cartridge unit 60 in accordance with an embodiment of the present invention.

Figure 3:
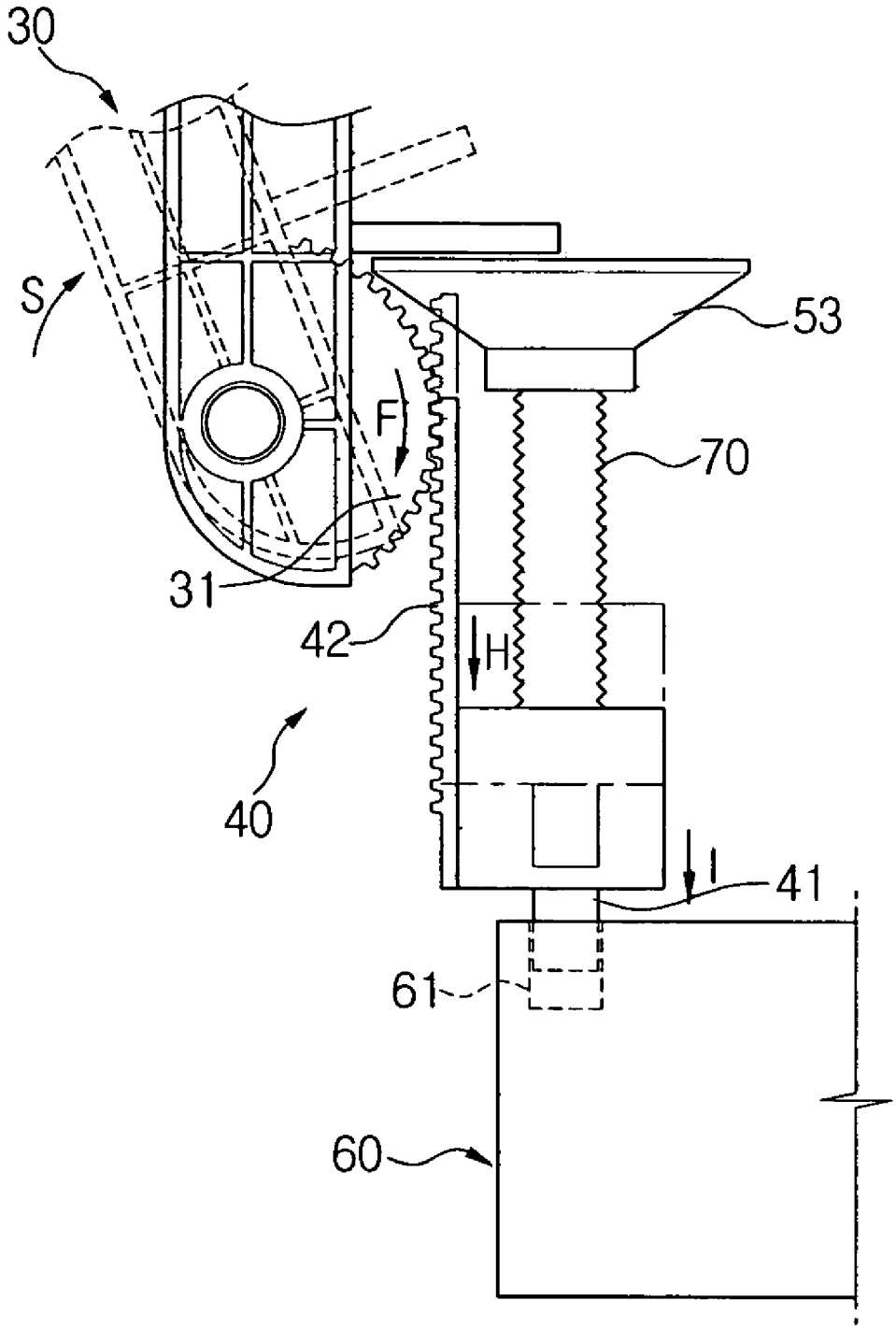
FIG. 3 is a view showing the fitting unit of FIG. 2.

FIG. 3 is a view showing the fitting unit 40 of FIG. 2 in greater detail. Referring to FIG. 3, the fitting unit 40 comprises a male fitting portion 41 to be engaged with the ink cartridge unit 60, and a fitting unit driver for engaging and disengaging the male fitting portion 41 with a female fitting portion 61 formed in the ink cartridge unit 60 according to the opening and closing movements of the door unit 30.

The fitting unit driver comprises a rotary member 31 disposed at the door unit 30, and a vertical member 42 engaged with the rotary member 31 to move in relation to the movement of the rotary member 31.

The male fitting portion 41 is connected with one side of the vertical member 42, which comprises a rack, and is secured to the rack using any suitable fastener, such as a screw.

The rotary member 31 is disposed at an end of the door unit 30 and is generally a gear that rotates in engagement with the vertical member 42.

It is preferred that the rotary member 31 and the vertical member 42 respectively comprise the gear and rack to transform a rotary motion into a linear motion.

A hose 70 connects a collecting receptacle 53 and the male fitting portion 41, and is expandable and contractible to maintain the connection therebetween when the male fitting portion 41 linearly moves in the arrowed direction "I".

In the above construction example, when the door unit 30 turns in the arrowed direction "S", the rotary member 31 disposed at the door unit 30 rotates in the arrowed direction "F" and thus the vertical member 42 engaged with the rotary member 31 linearly moves in the arrowed direction "H". At this time, the male fitting portion 41 connected with one side of the vertical member 42 linearly moves in the arrowed direction "I" and is fitted into, or engaged with, the female fitting portion 61.

Figure 4A:
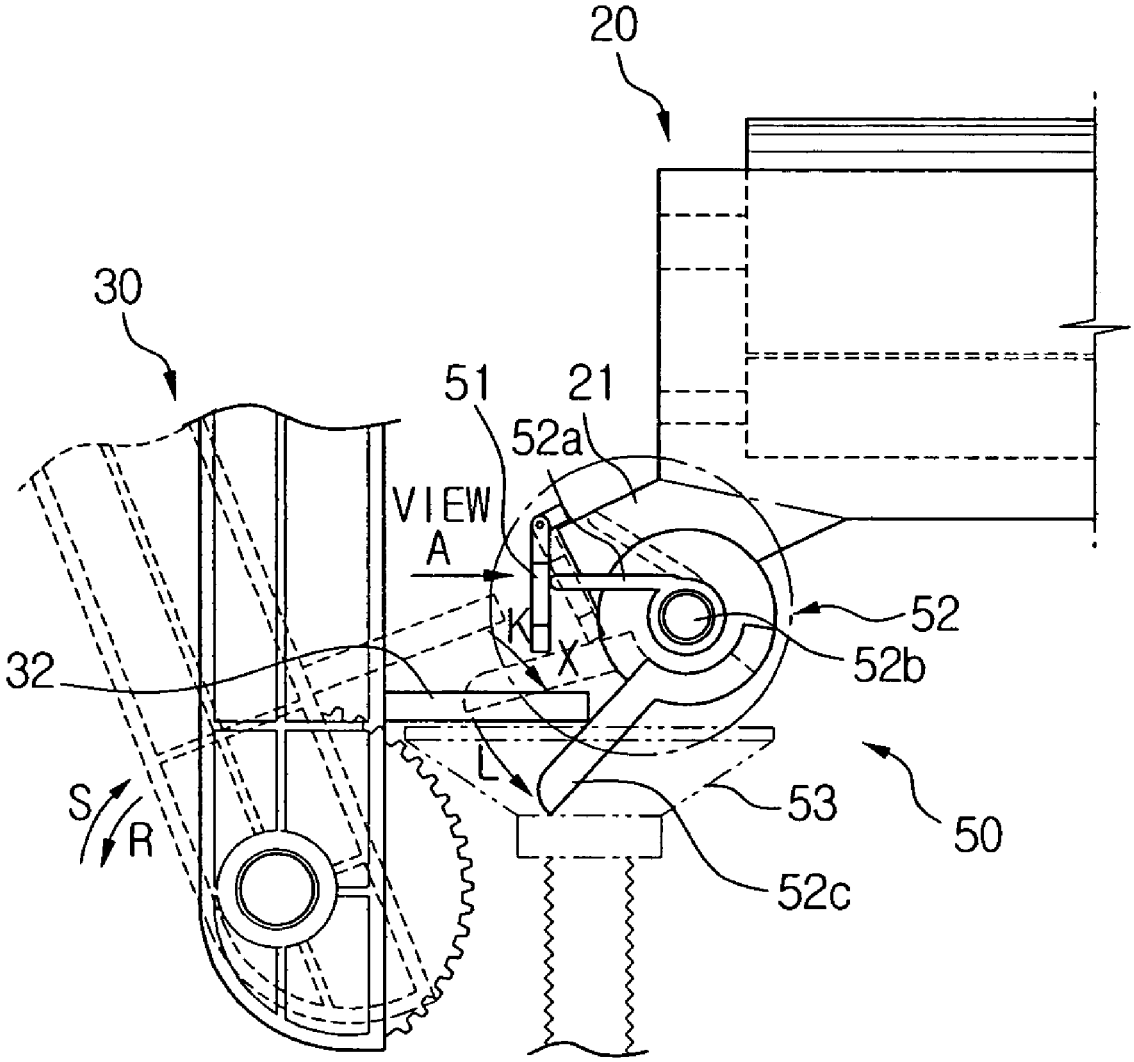
FIG. 4A is a view showing the ink recover unit of FIG. 2.
Figure 4B:
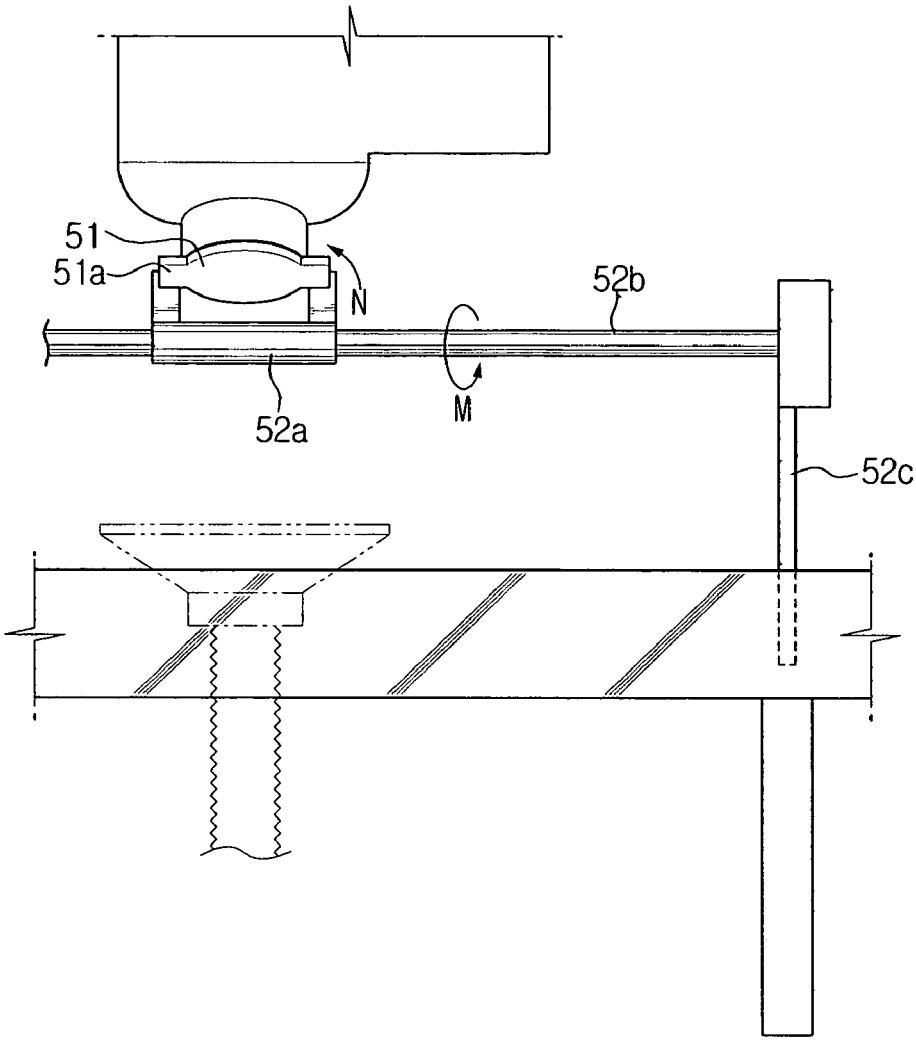
FIG. 4B is a view from the direction A of FIG. 4A.
Figure 4C:
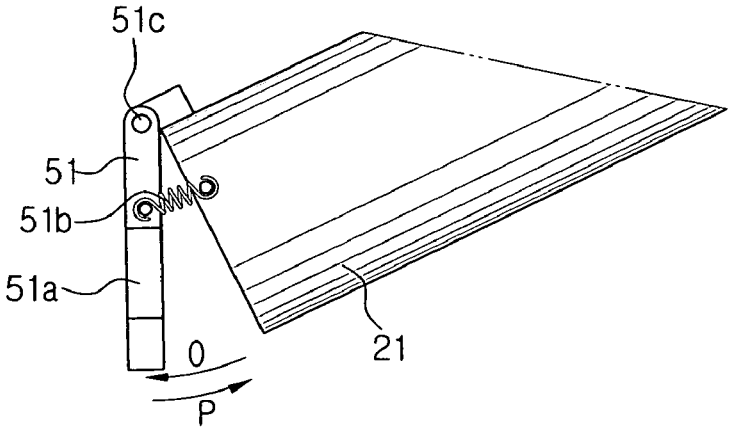
FIG. 4C is a view showing the ink discharge channel cover of FIG. 4B.

FIG. 4A illustrates the ink recover unit 50 of FIG. 2, FIG. 4B is a view from the direction A of FIG. 4A, and FIG. 4C is a view to illustrate the operation of an ink discharge channel cover 51 of FIG. 4B. Referring to FIGS. 4A, 4B, and 4C, the ink recover unit 50 comprises an ink recover unit driver 52 for opening and closing the ink discharge channel cover 51 according to the opening and closing of the door unit 30, and the collecting receptacle 53 for collecting the discharged ink X.

As shown in FIG. 4A, the ink recover unit driver 52 comprises an opening/closing member 52*a* for opening and closing the ink discharge channel cover 51, an opening/closing shaft 52*b* around which the opening/closing member 52*a* is engaged, and a clutch 52*c* engaged with the opening/closing shaft 52*b*.

Referring to FIGS. 4B and 4C, the ink discharge channel cover 51 includes protrusions 51*a* formed at opposite sides thereof, and is connected to an ink discharge channel 21 disposed at a lower part of the developing unit 20 by a hinge 51*c* on which the ink discharge channel cover 51 swings in the arrowed directions "0" and "P".

The opening/closing shaft 52*b* is rotatably connected with one side of the body 10 (see FIG. 2).

The opening/closing member 52*a* for opening and closing the ink discharge channel cover 51 is concave to push the protrusions 51*a* formed at the opposite sides of the ink discharge channel cover 51 in the arrowed direction "N". The opening/closing shaft 52*b* is inserted through the opening/closing member 52*a*.

The clutch 52*c* is inserted onto an end of the opening/closing shaft 52*b*, and is 'L' shaped to contact an operating lever 32 disposed at an end of the door unit 30.

The collecting receptacle 53 is secured to one side of the body 10 (see FIG. 2) for collecting the ink X falling from the ink discharge channel 21, and can be a funnel to prevent the ink from spattering.

Referring back to FIG. 4A, when the door unit 30 turns in the arrowed direction "S", the operating lever 32 disposed at the end of the door unit 30 moves in the arrowed direction "K" to thereby push the clutch 52*c* in the arrowed direction "L". At this time, the clutch 52*c* rotates the opening/closing shaft 52*b* in the arrowed direction "M".

Referring to FIGS. 4B and 4C, when the opening/closing shaft 52*b* rotates, the opening/closing member 52*a* engaged around the opening/closing shaft 52*b*, rotates in the arrowed direction "N". At this time, the opening/closing member 52*a* pushes the protrusions 51*a* formed at the opposite sides of the ink discharge channel cover 51 to thereby open the ink discharge channel cover 51 in the arrowed direction "O". Accordingly, the ink X is discharged by gravity from the ink discharge channel 21.

In the reverse order of the above process, when the door unit 30 turns in the arrowed direction "R", the opening/closing member 52*a* does not push the protrusions 51*a*, and the ink discharge channel cover 51 is closed in the arrowed direction "P" by a recovering force of a spring 51*b* connected between the ink discharge channel cover 51 and the ink discharge channel 21. Accordingly, the discharge of the ink X is stopped.

Figure 5A:
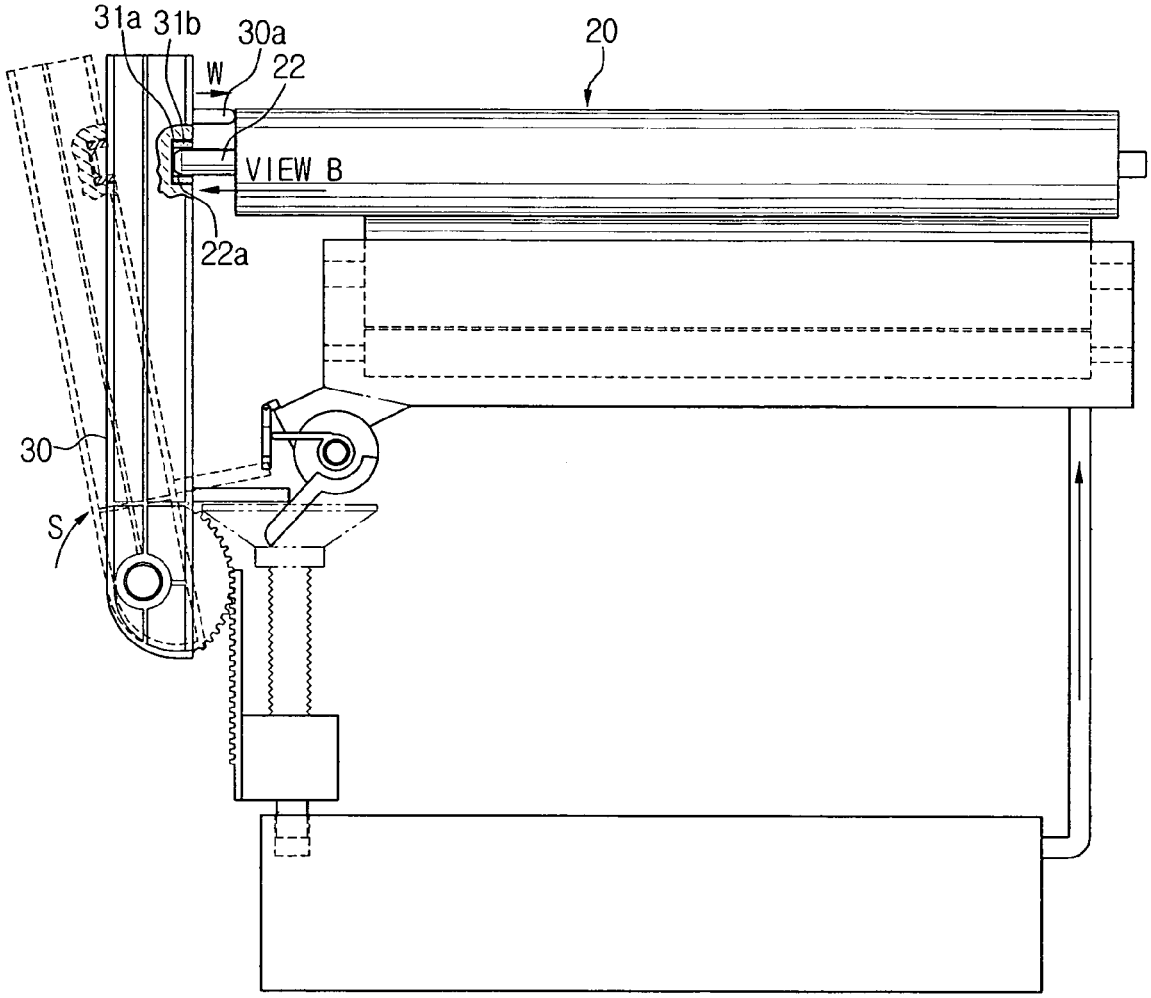
FIG. 5A is a view showing the door unit of FIG. 2.
Figure 5B:
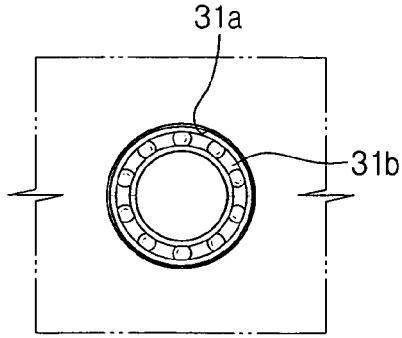
FIG. 5B is a view from the direction B of FIG. 5A.

FIG. 5A is a view showing the door unit of FIG. 2 in detail, and FIG. 5B is a view from the direction "B" of FIG. 5A. Referring to FIGS. 5A and 5B, the door unit 30 comprises a mounting supporter 30*a* for pushing the developing unit 20 in the arrowed direction "W" to completely mount the developing unit 20, and a recess 31*a* supporting and guiding a rotary shaft 22 of the developing unit 20.

A bearing 31*b* is inserted into the recess 31*a* to rotate the rotary shaft 22 of the developing unit 30. An end of the rotary shaft 22 has a chamfered end 22*a* to facilitate the insertion of the rotary shaft 22 into the bearing 31*b*.

When the door unit 30 turns in the arrowed direction "S", the mounting supporter 30*a* of the door unit 30 pushes the developing unit 20 in the arrowed direction "W" to thereby completely mount the developing unit 20.

The chamfered end 22*a* of the rotary shaft 22 of the developing unit 20 is inserted into the bearing 31*b* fitted into the recess 31*a* of the door unit 30. The rotary shaft 22 is thereby supported and rotated in the bearing 32*b*.

Figure 6:
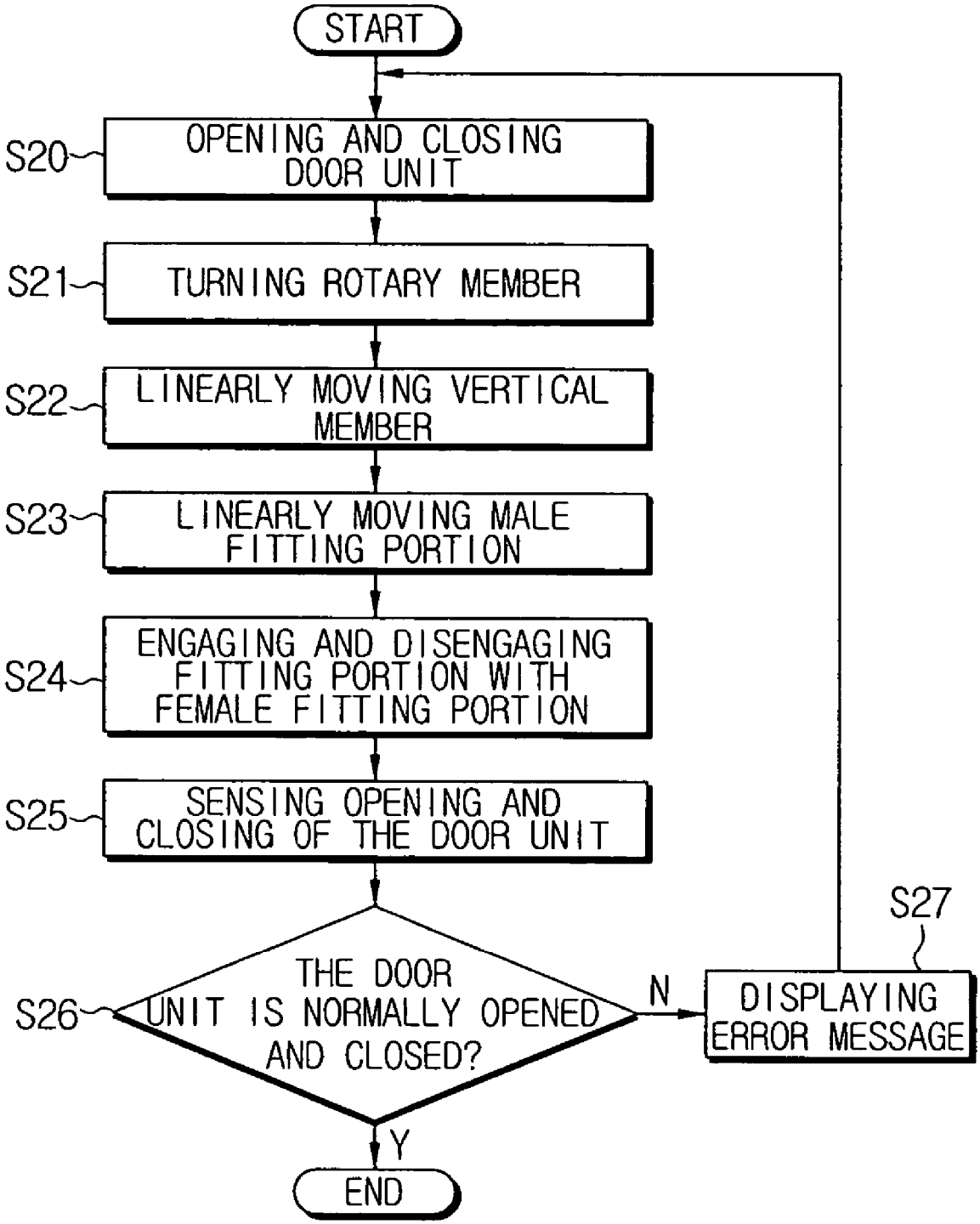
FIG. 6 is a flowchart showing the operation of the fitting unit of FIG. 3 according to an embodiment of the present invention.

FIG. 6 is a flowchart illustrating the operation of the fitting unit 40 of FIG. 3 according to an embodiment of the present invention. Referring to FIG. 6, a method of operating the fitting unit 40 comprises the steps of opening and closing the door unit 30 at step S20, thereby turning the rotary member 31 disposed at the door unit 30 at step S21, and linearly moving the vertical member 42 engaged with the rotary member 31 at step S22. The linear movement of the vertical member 42 results in linearly moving the male fitting portion 41 connected with the vertical member 42 at step S23, thereby engaging and disengaging the male fitting portion 41 of the fitting unit 40 with the female fitting portion 61 formed in the ink cartridge unit 60 at step S24. The operating method further provides sensing the opening and closing of the door unit 30 using a sensor disposed at one side of the door unit at step S25, determining whether the door unit 30 is normally opened and closed at step S26, and displaying an error message if the door unit 30 is not normally opened and closed at step S27.

Figure 7:
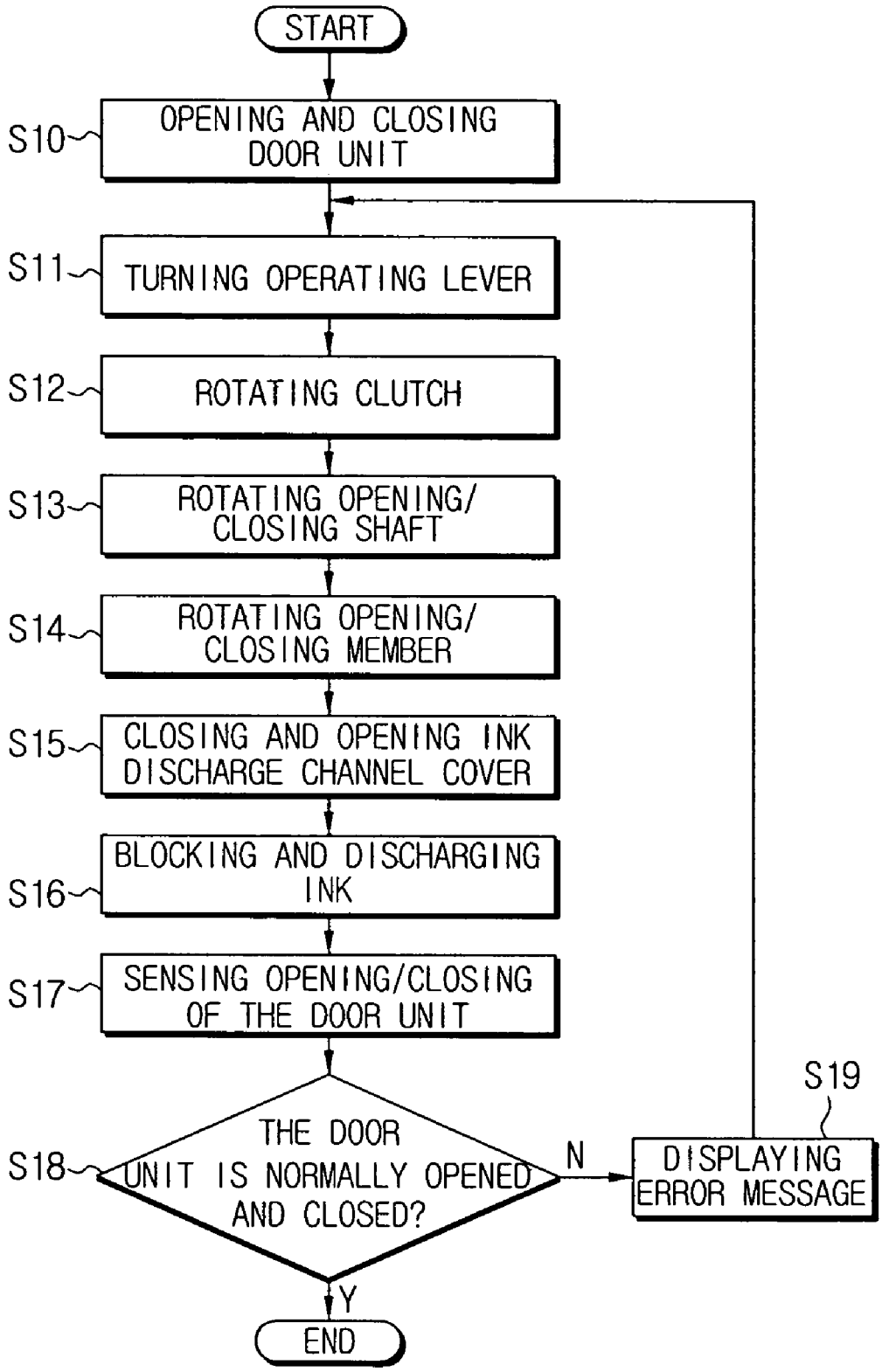
FIG. 7 is a flowchart showing the operation of the ink recover unit of FIG. 4A according to another embodiment of the present invention.

FIG. 7 is a flowchart showing the operation of the ink recover unit 50 of FIG. 4A according to another embodiment of the present invention. Referring to FIG. 7, an operating method of the ink recover unit 50 comprises the steps of opening and closing the door unit 30 at step S10, thereby turning the operating lever 32 disposed at the end of the door unit 30 at step S11 and rotating the clutch 52*c* in contact with the operating lever 32 at step S12. The rotating of the clutch 52*c* is provided for rotating the opening/closing shaft 52*b* on which the clutch 52*c* is disposed at step S13, thereby rotating the opening/closing member 52*a* disposed around the opening/closing shaft 52*b* at step S14. The rotating of the opening/closing member 52*a* is provided for closing and opening the ink discharge channel cover 51 disposed at the developing unit 20 at step S15, and thereby blocking discharge and allowing discharge of the ink, respectively, at step S16. The operating method further provides sensing the opening and closing of the door unit 30 using a sensor disposed at one side of the door unit at step S17, determining whether the door unit 30 is normally opened and closed at step S18, and displaying an error message if the door unit 30 is not normally opened and closed at step S19.

According to embodiments of the image forming apparatus as constructed above, a user can easily and precisely set the fitting unit 40 and the ink recover unit 50 using the door unit 30. Also, the door unit 30 completely mounts the developing unit 20 and supports and guides the rotary shaft of the developing unit 20, thereby facilitating a color-registration stabilized wet-type electrophotographic image forming apparatus.

Although a number of exemplary embodiments of the present invention have been described, it will be understood by those skilled in the art that the present invention should not be limited to the described embodiments, but various changes and modifications can be made within the spirit and scope of the present invention as defined by the appended claims.

What is claimed is:

1. A wet-type electrophotographic image forming apparatus comprising:

a body;

a developing unit disposed in the body;

an ink cartridge unit disposed in the body;

a door unit disposed in the body; and a fitting unit connecting the developing unit and the ink cartridge unit, wherein the door unit is geared with the fitting unit, such that the door unit moves in relation to a movement of the fitting unit.

2. The wet-type electrophotographic image forming apparatus as claimed in claim 1, wherein:

the fitting unit is engaged and disengaged with the ink cartridge unit in response to the closing and opening movements of the door unit, respectively.

3. The wet-type electrophotographic image forming apparatus as claimed in claim 2, wherein:

the ink cartridge unit includes a female fitting portion formed therein; and the fitting unit includes a male fitting portion and a fitting unit driver, the fitting unit driver being operated in response to the closing and opening movements of the door unit to engage and disengage the male fitting portion with the female fitting portion.

4. The wet-type electrophotographic image forming apparatus as claimed in claim 3, wherein the fitting unit driver comprises:

a rotary member disposed at the door unit; and a vertical member moving in engagement with the rotary member, the vertical member transforming a rotational motion of the rotary member into a linear motion of the vertical member.

5. The wet-type electrophotographic image forming apparatus as claimed in claim 1, wherein the door unit includes a mounting supporter to substantially mount the developing unit.

6. The wet-type electrophotographic image forming apparatus as claimed in claim 5, further comprising a sensor for detecting whether the door unit is opened or closed.

7. The wet type electrophotographic image forming apparatus as claimed in claim 5, wherein a rotary shaft is disposed in the developing unit, and a recess is defined in the door unit to support the rotary shaft.

8. The wet-type electrophotographic image forming apparatus as claimed in claim 7, wherein a bearing is fitted into the recess.

9. A wet-type electrophotographic image forming apparatus comprising:

a body;

a developing unit disposed in the body;

an ink cartridge unit disposed in the body;

a door unit disposed in the body;

an ink recover unit disposed in the body; and a fitting unit connecting the developing unit and the ink cartridge unit, wherein the door unit is geared with the fitting unit, and the door unit moves in relation to a movement of at least one of the fitting unit and the ink recover unit.

10. The wet-type electrophotographic image forming apparatus as claimed in claim 9, wherein:

the fitting unit is engaged and disengaged with the ink cartridge unit in response to the closing and opening movements of the door unit, respectively.

11. The wet-type electrophotographic image forming apparatus as claimed in claim 9, wherein:

the ink recover unit is operated in response to the closing and opening movements of the door unit.

12. The wet-type electrophotographic image forming apparatus as claimed in claim 11, wherein:

the developing unit includes an ink discharge channel cover; and the ink recover unit includes an ink recover unit driver for opening and closing the ink discharge channel cover in response to the closing and opening movements of the door unit, respectively, and further includes an ink receptacle for collecting the discharged ink.

13. The wet-type electrophotographic image forming apparatus as claimed in claim 12, wherein an operating lever is disposed at the door unit to operate the ink recover unit driver, and the ink recover unit driver comprises:

an opening and closing member to open and close the ink discharge channel cover;

an opening and closing shaft engaged with the opening and closing member; and a clutch mounted on the opening and closing shaft, the clutch operating via contact with the operating lever.

14. The wet-type electrophotographic image forming apparatus as claimed in claim 9, wherein the door unit has a mounting supporter to substantially mount the developing unit.

15. A wet-type electrophotographic image forming apparatus comprising:

a body;

a developing unit disposed in the body;

an ink cartridge unit disposed in the body;

a door unit disposed in the body; and an ink recover unit disposed in the body comprising an ink recover unit driver, wherein the door unit moves in relation to a movement of the ink recover unit driver.

16. The wet-type electrophotographic image forming apparatus as claimed in claim 15, wherein:

the ink recover unit driver is operated in response to the opening and closing movements of the door unit.

17. The wet-type electrophotographic image forming apparatus as claimed in claim 15, wherein the door unit has a mounting supporter to substantially mount the developing unit.

18. A method for setting a wet-type electrophotographic image forming apparatus comprising the steps of:

opening and closing a door unit; and moving a fitting unit in relation to the movement of the door unit, wherein the door unit is geared with the fitting unit, such that the fitting unit is engaged and disengaged with an ink cartridge unit in response to the opening and closing of the door unit, respectively.

19. The method as claimed in claim 18, wherein the step of moving the fitting unit comprises the steps of:

rotating a rotary member disposed at the door unit;

linearly moving a vertical member in engagement with the rotary member; and linearly moving a male fitting portion disposed at the vertical member.

20. The method as claimed in claim 19, further comprising the step of detecting the opening and closing of the door unit using a sensor disposed at one side of the door unit.

21. The method as claimed in claim 20, further comprising the step of determining whether the door unit is opened or closed.

22. The method as claimed in claim 21, further comprising the step of displaying an error message when the door unit is opened.

23. The method as claimed in claim 18, further comprising the steps of:

moving the ink recover unit in relation to the movement of the door unit; and discharging the ink from a developing unit.

24. The method as claimed in claim 23, wherein the step of moving the ink recover unit comprises the steps of:

rotating an operating lever disposed at the door unit;

rotating a clutch in contact with the operating lever;

rotating an opening and closing shaft on which the clutch is disposed;

rotating an opening and closing member disposed around the opening and closing shaft; and opening or closing an ink discharge channel cover disposed at the developing unit.

25. A wet-type electrophotographic image forming apparatus comprising:

a body;

a developing unit disposed in the body;

an ink cartridge unit disposed in the body, wherein the ink cartridge unit comprises a female fitting portion formed therein;

a door unit disposed in the body; and a fitting unit connecting the developing unit and the ink cartridge unit, wherein the fitting unit comprises a male fitting portion and a fitting unit driver, the fitting unit driver being operated in response to the closing and opening movements of the door unit to engage and disengage the male fitting portion with the female fitting portion, wherein the door unit moves in relation to a movement of the fitting unit and the fitting unit is engaged and disengaged with the ink cartridge unit in response to the closing and opening movements of the door unit, respectively.

26. The wet-type electrophotographic image forming apparatus as claimed in claim 25, wherein the fitting unit driver comprises:

a rotary member disposed at the door unit; and a vertical member moving in engagement with the rotary member, the vertical member transforming a rotational motion of the rotary member into a linear motion of the vertical member.

27. A wet-type electrophotographic image forming apparatus comprising:

a body;

a developing unit disposed in the body;

an ink cartridge unit disposed in the body;

a door unit disposed in the body;

an ink recover unit disposed in the body; and a fitting unit connecting the developing unit and the ink cartridge unit, wherein the door unit moves in relation to a movement of at least one of the fitting unit and the ink recover unit, wherein the ink recover unit is operated in response to the closing and opening movements of the door unit.

28. The wet-type electrophotographic image forming apparatus as claimed in claim 27, wherein:

the developing unit includes an ink discharge channel cover; and the ink recover unit includes an ink recover unit driver for opening and closing the ink discharge channel cover in response to the closing and opening movements of the door unit, respectively, and further includes an ink receptacle for collecting the discharged ink.

29. The wet-type electrophotographic image forming apparatus as claimed in claim 28, wherein an operating lever is disposed at the door unit to operate the ink recover unit driver, and the ink recover unit driver comprises:

an opening and closing member to open and close the ink discharge channel cover;

an opening and closing shaft engaged with the opening and closing member; and a clutch mounted on the opening and closing shaft, the clutch operating via contact with the operating lever.

30. A wet-type electrophotographic image forming apparatus comprising:

a body;

a developing unit disposed in the body;

an ink cartridge unit disposed in the body;

a door unit disposed in the body; and an ink recover unit disposed in the body, wherein the door unit moves in relation to a movement of the ink recover unit and the ink recover unit is operated in response to the opening and closing movements of the door unit.

31. A method for setting a wet-type electrophotographic image forming apparatus comprising the steps of:

opening and closing a door unit;

moving a fitting unit in relation to the movement of the door unit, such that the fitting unit is engaged and disengaged with an ink cartridge unit in response to the opening and closing of the door unit, respectively;

moving the ink recover unit in relation to the movement of the door unit; and discharging the ink from a developing unit.

32. The method as claimed in claim 31, wherein the step of moving the ink recover unit comprises the steps of:

rotating an operating lever disposed at the door unit;

rotating a clutch in contact with the operating lever;

rotating an opening and closing shaft on which the clutch is disposed;

rotating an opening and closing member disposed around the opening and closing shaft; and opening or closing an ink discharge channel cover disposed at the developing unit.

33. A method for setting a wet-type electrophotographic image forming apparatus comprising the steps of:

opening and closing a door unit;

moving a fitting unit in relation to the movement of the door unit, such that the fitting unit is engaged and disengaged with an ink cartridge unit in response to the opening and closing of the door unit, respectively, by rotating a rotary member disposed at the door unit, linearly moving a vertical member in engagement with the rotary member, and linearly moving a male fitting portion disposed at the vertical member.

34. The method as claimed in claim 33, further comprising the step of detecting the opening and closing of the door unit using a sensor disposed at one side of the door unit.

35. The method as claimed in claim 34, further comprising the step of determining whether the door unit is opened or closed.

36. The method as claimed in claim 35, further comprising the step of displaying an error message when the door unit is opened.

* * * * *